US005429486A

United States Patent [19]

Schock et al.

[11] Patent Number: 5,429,486

[45] Date of Patent: Jul. 4, 1995

[54] SINGLE ROLLER BLOOD PUMP AND OXYGENATOR SYSTEM

[75] Inventors: Robert B. Schock, Sparta; Boris Leschinsky, Waldwick, both of N.J.

[73] Assignee: Datascope Investment Corp., Montvale, N.J.

[21] Appl. No.: 243,943

[22] Filed: May 17, 1994

Related U.S. Application Data

[60] Division of Ser. No. 88,573, Jul. 9, 1993, Pat. No. 5,342,181, which is a continuation of Ser. No. 898,673, Jun. 15, 1992, abandoned.

[51] Int. Cl.[6] ..... F04B 43/08

[52] U.S. Cl. ..... 417/476; 417/477.8; 417/477.9

[58] Field of Search ..... 417/474, 476, 477 R, 417/477 B, 477 F, 477 G, 477 E, 477 H, 477.1, 477.3, 477.7, 477.8, 477.6, 477.9; 604/153

[56] References Cited

U.S. PATENT DOCUMENTS

| | | | |
|---|---|---|---|
| 365,327 | 6/1887 | Allen | 417/476 |
| 409,000 | 8/1889 | Allen | 417/476 |
| 424,944 | 4/1890 | Allen | 417/476 |
| 526,903 | 6/1894 | Messmer | 144/152 |
| 537,049 | 4/1895 | Lewis | 417/476 |
| 2,231,579 | 1/1938 | Huber | 417/478 |
| 2,414,355 | 1/1947 | Bogoslowsky | 417/476 |
| 2,705,493 | 4/1955 | Malmros et al. | 128/214 |
| 2,885,967 | 5/1959 | Vogel et al. | 417/477 E |
| 2,988,001 | 6/1961 | D'Arcey et al. | 417/429 |
| 3,508,587 | 4/1970 | Mavch | 138/119 |
| 3,513,845 | 5/1970 | Chestnut et al. | 128/214 |
| 3,515,640 | 6/1970 | Rudlin | 195/1.8 |
| 3,674,383 | 7/1972 | Iles | 417/476 |
| 3,687,580 | 8/1972 | Griffiths | 418/45 |
| 3,903,895 | 9/1975 | Alley et al. | 128/350 R |
| 4,131,399 | 12/1978 | Calvet | 417/477 |
| 4,138,205 | 2/1979 | Wallach | 417/360 |
| 4,174,193 | 11/1979 | Sakakibara | 417/477 |
| 4,178,138 | 12/1979 | Iles | 417/477 |
| 4,179,249 | 12/1979 | Guttmann | 417/477 |
| 4,205,948 | 6/1980 | Jones | 417/477 G |
| 4,231,725 | 11/1980 | Hogan | 417/477 |

(List continued on next page.)

FOREIGN PATENT DOCUMENTS

| | | | |
|---|---|---|---|
| 566733 | 2/1924 | France . | |
| 2025611 | 12/1969 | France | 417/475 |
| 53-4205 | 1/1978 | Japan . | |
| 21604 | 10/1929 | Netherlands | 417/477 |
| 1021811 | 6/1983 | U.S.S.R. | 417/476 |

OTHER PUBLICATIONS

Modern Plastics Encyclopedia 1989, p. 304.

Henker and Murdaugh, "Effects of Pneumatic Artificial Heart Driver on the Rate of Isovolumic Pressure Rise", (List continued on next page.)

*Primary Examiner*—Richard A. Bertsch

*Assistant Examiner*—Peter G. Korytnyk

*Attorney, Agent, or Firm*—Fitzpatrick, Cella, Harper & Scinto

[57] ABSTRACT

A pump and pump/oxygenator system including a generally cylindrical pump housing, a tube arranged in a helical turn within the pump housing, and a rotor assembly rotatably mountable in the housing for pumping fluid through the tube by peristaltic action. The tube may be preformed with a D-shaped cross-section, a helical turn of about 380° and a compression portion having a decreasing volume per unit length in a direction from the proximal end to the distal end thereof. In one aspect, the rotor assembly includes a cam operated occlusivity adjusting mechanism for translating the drive roller in a radial direction of the rotor assembly from a non-occluding storage position to a tube-occluding operative position. In another aspect, the housing includes a door forming an arcuate portion of the sidewall of the housing. The door may be opened to a storage position that allows the tube, at least in part, to extend outside the housing, such that the pump may be stored or shipped without the tube being occluded by the drive roller. In yet another aspect, the housing and drive roller have complementary conical tapers, and occlusion of the tube is controlled by translating the rotor assembly along its axis from a non-occluding storage position to a operative position in which the drive roller occludes the tube.

21 Claims, 7 Drawing Sheets

U.S. PATENT DOCUMENTS

| | | | |
|---|---|---|---|
| 4,239,464 | 12/1980 | Hein | 417/474 |
| 4,289,459 | 9/1981 | Neeley et al. | 417/477 R |
| 4,371,321 | 2/1983 | Koblo et al. | 417/476 |
| 4,451,562 | 5/1984 | Elgas et al. | 435/2 |
| 4,452,599 | 6/1984 | Albisser et al. | 604/49 |
| 4,504,200 | 3/1985 | Olson | 417/476 |
| 4,522,571 | 6/1985 | Little | 417/476 |
| 4,529,397 | 7/1985 | Hennemuth et al. | 604/4 |
| 4,530,647 | 7/1985 | Uno | 417/478 |
| 4,540,351 | 9/1985 | Olson | 417/476 |
| 4,540,399 | 9/1985 | Litzie et al. | 607/4 |
| 4,552,516 | 11/1985 | Stanley | 417/477 |
| 4,559,040 | 12/1985 | Horres et al. | 604/153 |
| 4,610,656 | 9/1986 | Mortensen | 604/4 |
| 4,645,434 | 2/1987 | Bogen | 417/476 |
| 4,685,902 | 8/1987 | Edwards et al. | 604/153 |
| 4,756,705 | 7/1988 | Beijbom et al. | 604/4 |
| 4,798,580 | 1/1989 | DeMeo et al. | 604/30 |
| 4,828,543 | 5/1989 | Weiss et al. | 604/4 |
| 4,906,168 | 3/1990 | Thompson | 417/477 |
| 4,954,055 | 9/1990 | Raible et al. | 417/477 |
| 4,976,593 | 12/1990 | Miyamoto | 417/476 |
| 4,995,268 | 2/1991 | Ash et al. | 73/861.05 |
| 5,009,573 | 4/1991 | Ring et al. | 417/477 G |
| 5,173,038 | 12/1992 | Hopfensperger et al. | 417/476 |
| 5,318,413 | 6/1994 | Bertoncini | 417/474 |
| 5,342,181 | 8/1994 | Schock et al. | 417/476 |

OTHER PUBLICATIONS

Artificial Organs, vol. 12, No. 6, pp. 519–525 (1988).

Lewis, et al., "A Combined Membrane Pump–Oxygenator: Design and Testing" Trans. Amer. Soc. Artif. Int. Organs, vol. XX pp. 253–261 (1974).

Frantz, et al., "A Membrane Combined Oxygenator and Pump—Principles" Trans. Amer. Soc. Artif. Int. Organs, vol. XIV, pp. 233–235 (1968).

Galletti, "Heart–Lung Bypass" Grune & Stratton, pp. 121–140 (1962).

Wesolowski, "Chapter 8: Roller Pumps", Pumps, pp. 77–79 (Undated).

Cole–Parmer Instrument Co., "Masterflex® Tubing Pump Systems" pp. 1–24 (Undated).

Cole–Parmer Instrument Co., "Instruments for Research, Industry and Education", pp. 766–767 (1991–1992).

FIG. 1
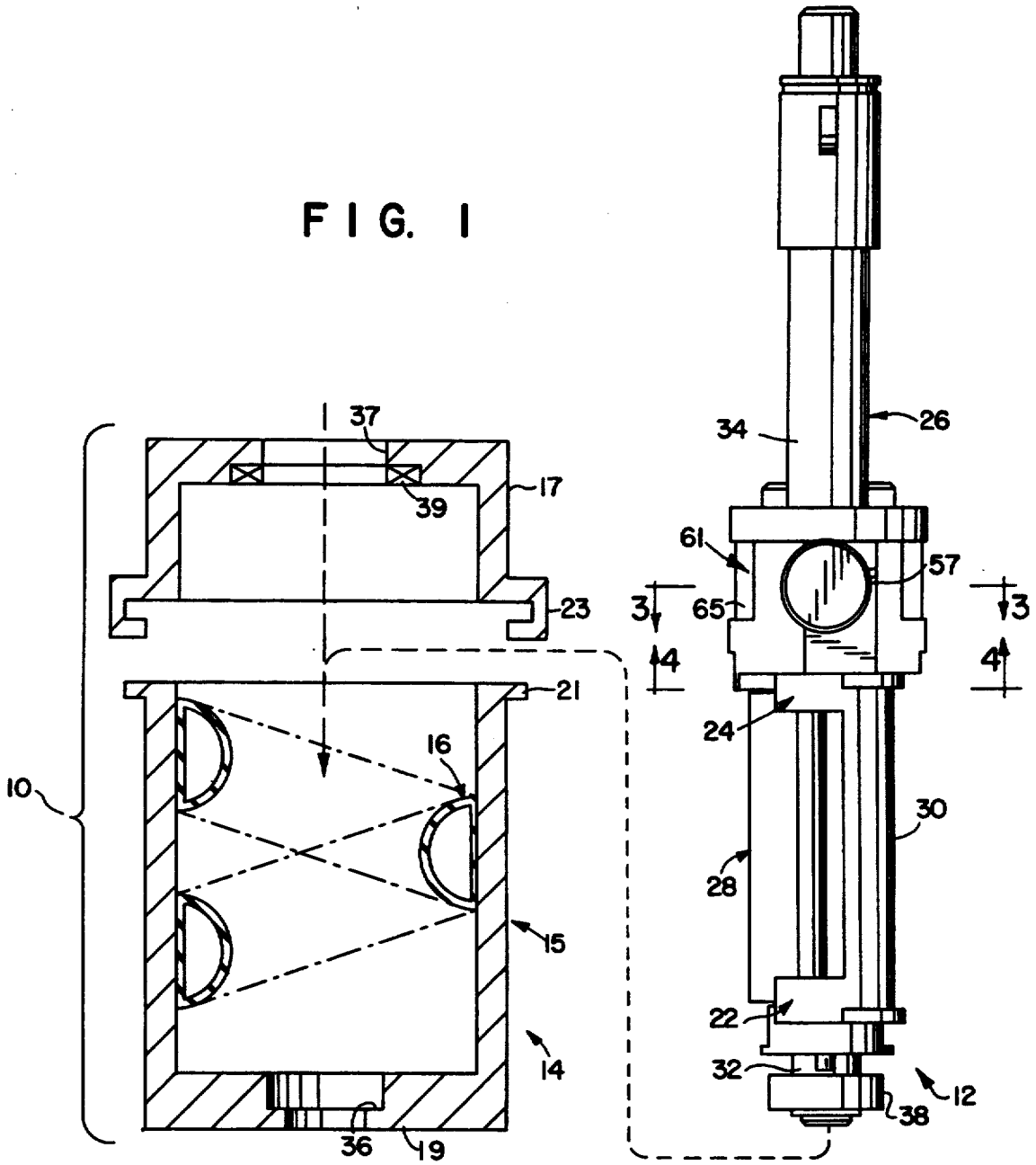
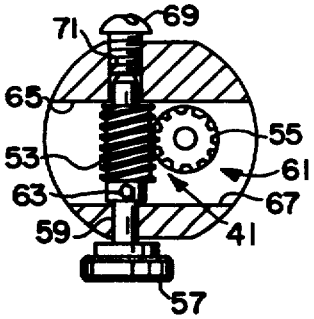
FIG. 3
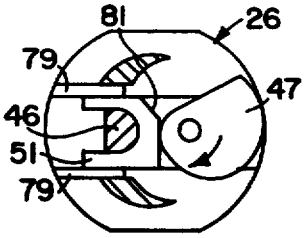
FIG. 4A
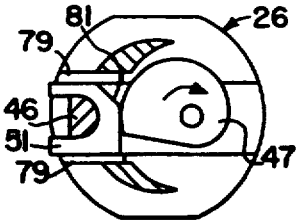
FIG. 4B

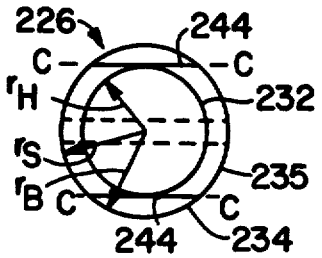
FIG. 9
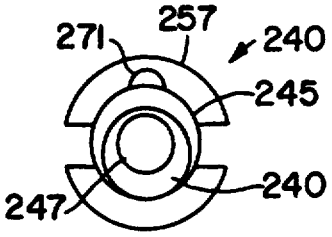
FIG. 11
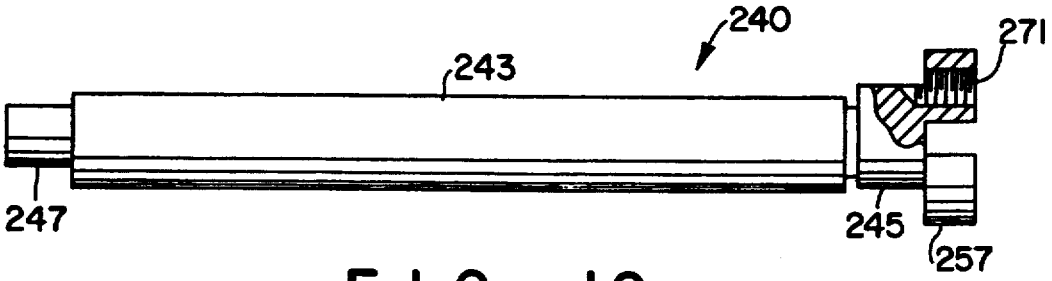
FIG. 10
FIG. 12
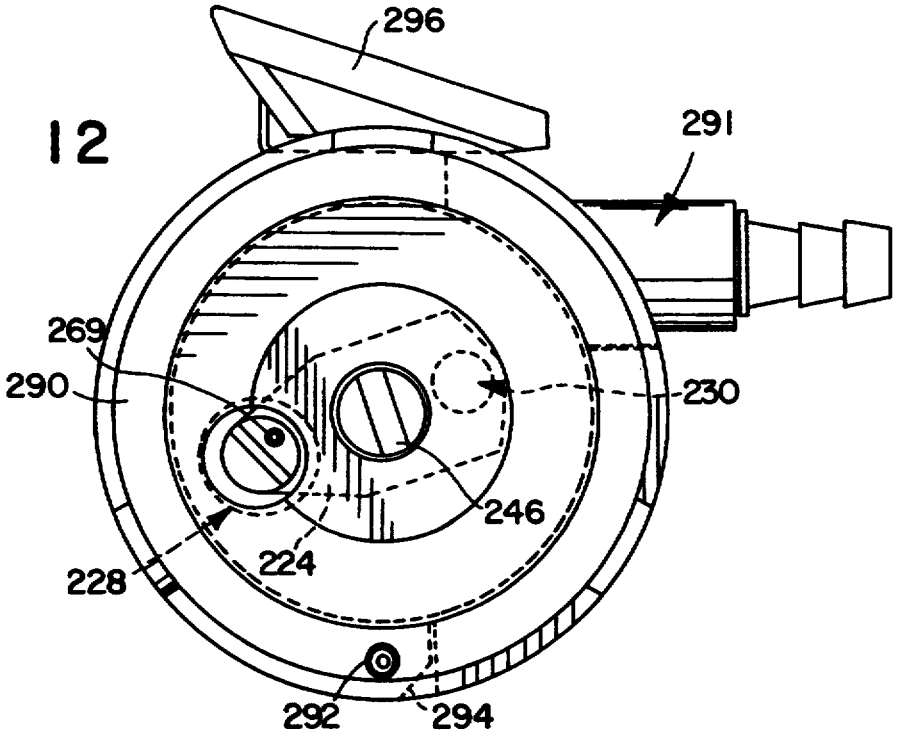

SINGLE ROLLER BLOOD PUMP AND OXYGENATOR SYSTEM

This application is a division of application Ser. No. 08/088,573, filed Jul. 9, 1993, now U.S. Pat. No. 5,342,181, which is a continuation of 07/898,673, filed Jun. 15, 1992, now abandoned.

BACKGROUND OF THE INVENTION

1. Field of the Invention

The present invention relates generally to a peristaltic pump. More particularly, it relates to a blood pump including a rotor assembly having a single drive roller, a counter-balance support, and a preformed pump chamber or tube arranged in a generally cylindrical pump housing. The rotor assembly, the preformed tube the housing or a combination thereof, may be disposable,. The present invention finds particular utility in extracorporeal medical procedures, for example, where used in combination with a blood oxygenator as a heart-/lung device for emergency procedures. Of course, the roller pump of the present invention may be found to have equal advantage in other procedures and applications.

2. Description of the Prior Art

Blood pumps for extracorporeal procedures are known. Generally, those procedures include withdrawing oxygen depleted blood from a patient, e.g., from a femoral vein of the patient, circulating the blood through a pump and oxygenator system, commonly called a heart/lung machine, and reintroducing the oxygenated blood into the patient, e.g., through the femoral artery of the patient. Known blood pumps generally include centrifugal pumps, screw pumps, turbine pumps, diaphragm pumps and roller pumps.

Of these, roller pumps provide particular utility in extracorporeal procedures. Generally, roller pumps are advantageous because the blood handling portion of the pump, which must be sterile, is simply a piece of tubing with a very low volume. The low volume tube is advantageous because the supply of blood available for surgical procedures may be limited, particularly for emergency procedures or pediatric procedures. Also, since a blood pump often is primed with a saline solution, the low volume tube minimizes any adverse consequences of hemodilution. Thus, the low volume tube facilitates quick, easy, sterile priming of the pump. In addition, the volume output of a roller pump per minute is proportional to the number of revolutions per minute of the roller. Therefore, the volume output of a roller pump is an easily controlled variable during extracorporeal circulation.

Roller pumps generally are described either as single roller, twin roller or multiple roller pumps. A single roller pump generally comprises a cylindrical housing in which a 360° loop of tubing is inserted. Typically, a large single eccentric roller is disposed within the loop for rotation on a drive shaft. A cam structure typically is provided for radially adjusting the roller relative to the loop so as to close, or occlude, the lumen of the blood tube. Alternatively, the roller can be biased radially by a spring. In each case, rotation of the drive shaft and roller provides a steadily progressive compression of the loop that "milks" the fluid out of the tube, e.g., by peristaltic action.

A twin roller pump typically comprises a semicylindrical housing in which a tube is disposed to form a 180° turn or U-shape. A pair of rollers are disposed at ,opposite ends of a rotor arm pivotally disposed on a drive shaft about a common axis with the 180° U-turn of the tube. Each roller may be provided with a cam structure for adjusting the tube occlusivity setting, or a spring structure for biasing the roller against the tube. Rotation of the drive shaft rotates each roller about the common axis of the housing to provide a steadily progressive compression of the 180° turn and to milk the fluid out of the tube, e.g., by peristaltic action. Thus, in a twin roller pump, each full rotation of the drive shaft provides two successive compression cycles, one for each of the twin rollers.

U.S. Pat. No. 4,179,249 (Guttman) describes a multiple roller pump. More particularly, it describes a peristaltic pump including a rotor assembly having three drive rollers. In the Guttman patent pump, a pair of reaction members (18,20) pivotally are mounted on a base plate (12) for movement between an open position and a closed position relative to a rotor assembly (14). The rotor assembly (14) includes a pair of support disks (44,46) and three drive rollers (**48*a,b,c*) disposed therebetween. The reaction members each have: a cam surface or channel formed therein, and are releasably retained in the closed position by a locking plate (26). In operation, a compressible tube is disposed around the rotor assembly in a U-shaped configuration when the reaction members are in the open position. The reaction members then are closed so that the compression tube is registered in the channel. The rollers are mounted between the support disks such that their outer cylindrical surfaces define compression surfaces for rolling engagement with the compressible tube during operation of the pump. Rotation of the rotor assembly causes the rollers to progressively compress the U-shaped segment of the compressible tube to pump fluid therethrough, e.g., by peristaltic action. Thus, each full rotation of the rotor assembly provides three successive compression cycles, one for each of the three drive rollers (48*a,b,c***).

A drawback of conventional single roller pumps is kinking. Conventional roller pumps generally are designed to accommodate a standard or straight flexible tube drawn around in a turn or loop. However, a straight tube having a diameter of about ¼ inch or greater tends to kink when rolled in a spiral turn or loop of a size suitable for a blood pump. Moreover, this tendency to kink increases when a roller is applied to engage the tube and occlude it.

A drawback of conventional twin and multiple roller blood pumps is size. A flexible tube has an associated recovery time, i.e., the period of time required for the tube to reopen after being pinched or occluded. Of course, as the tube reopens, it is refilled with fluid to be pumped out. Therefore, failure of the tube to substantially reopen reduces the output efficiency of the pump. For any given tube, increasing the number of drive rollers symmetrically disposed about the rotor assembly lowers the time between strokes, i,e., the time permitted for recovery and, thus limits the maximum rpm of the motor assembly for a desired efficiency. Therefore, in order to increase the maximum rpm, and thus the flow capacity, known twin and multiple roller blood pumps often are large, and often require occlusivity adjustment before use. Moreover, these pumps typically require a relatively long set-up time, e.g., up to 40 minutes, to insure safe operation.

A drawback of all conventional roller pumps in extracorporeal applications is hydroshock. Hydroshock is caused by a sudden change in localized pressure of the blood. Recent research performed in connection with artificial hearts suggests that hydroshock is a major etiology for hemolysis, with subsequent thrombus formation (See Henker & Murdaugh, "Effects of Pneumatic Artificial Heart Driver on the Rate of Isovolumic Pressure Rise," *Artificial Organs*, Vol. 12, No. 6, p. 519 (1988). Thrombus can cause stroke or other serious complications.

Hydroshock occurs in conventional roller pumps at the end of each pump cycle. As described above, a roller pump drives fluid by progressively compressing a tubular pump chamber. During operation of the roller pump, the outlet of the pump chamber (tube) communicates with the relatively high arterial pressure, and the inlet of the pump chamber communicates with the relatively low venous pressure. Accordingly, during each cycle of the roller, blood in the tube preceding the roller, i.e.., on the downstream side, is exposed to the relatively high arterial pressure. Blood in the tube succeeding the roller, i.e., on the upstream side, is at the relatively low venous pressure. When the roller disengages the tube at the end of the cycle, the preceding and succeeding portions of the tube come into fluid communication. Thus, blood in the preceding portion of the tube experiences a pressure drop, and blood in the succeeding portion of the tube is exposed to a sudden localized increase in pressure, or hydroshock. A sudden decrease in blood pressure may be harmful to the patient. Moreover, the hydroshock may cause hemolysis, thrombus or .other complications.

Another drawback of conventional blood roller pumps is tube occlusion during storage. As described above, a roller pump acts by progressively occluding, or pinching, a flexible rubber tube. As the roller progressively occludes the tube, the flexible tube progressively reopens behind the roller. However, during storage the roller is static. Thus, if the pump is stored with the tube resident therein, then the drive roller typically occludes a portion of the tube, and that portion tends to retain an occlusion "memory," whereby the portion always remains somewhat occluded, even when the pump later is taken out of storage and driven so that the roller progressively occludes the tube. This occlusion memory reduces the total volume of blood flow through the pump. More importantly, it makes it difficult for a clinician to accurately control the blood flow volume and pressure. Accordingly, conventional pumps typically are designed for storage without the tube resident therein, and require additional set-up time.

SUMMARY OF THE INVENTION

These and other drawbacks of the prior art are overcome by the present invention, which provides a blood pump having a generally cylindrical housing, a rotor assembly having a single drive roller, and a pump chamber or tube arranged in a helical turn. In one aspect, the pump chamber (tube) is arranged in a helical turn of about a 380° and includes a compression portion formed at its inlet side. For each cycle, the pump chamber (tube) initially is charged at its inlet side with a volume of blood at venous pressure, the volume of the pump chamber (tube) charged with the blood gradually is reduced to compress the blood and elevate the blood pressure to arterial pressure, and the volume of blood is discharged from the pump chamber (tube) at its outlet side at arterial pressure. The pump chamber preferably is a preformed tube having a generally D-shaped cross-section.

In one embodiment, a pump of the present invention combines a disposable housing and preformed tube, and a reusable rotor assembly, including a single drive roller. The rotor assembly is provided with precision occlusivity adjusting structure to provide accurate blood flow during procedure and interchangeability with successive pump housings. In this embodiment, occlusivity memory may be eliminated by storing the housing and tube separately from the rotor assembly. Alternatively, occlusivity memory may be eliminated by fully retracting the drive roller using the occlusivity adjusting structure. This arrangement also facilitates quick, unobstructed insertion and removal of the rotor assembly from the housing.

In another embodiment, a pump of the present invention includes a disposable housing, preformed tube and rotor assembly, including a single drive roller. Precision occlusivity structure is provided and may be preset, e.g., during manufacture, or adjusted during procedure. The housing is provided with an access/storage door, preferably forming about a 270° arcuate portion of the generally cylindrical housing, at a contact portion of the preformed tube. The door is opened for storage and shipping of the pump to prevent occlusivity memory caused by pinching of the tube between the drive roller and the housing at the contact portion. The door is closed for procedure to provide a preset precision occlusivity.

In yet another embodiment, a pump of the present invention includes a housing, a preformed tube and a rotor assembly, where the housing and a drive roller of the rotor assembly have complementary conical-shaped contact surfaces. The rotor assembly is provided with self-advancing structure, e.g., a threaded shaft, for advancing between a storage position at the open end of the conical housing and an operation position at the closed end of the conical housing. Occlusivity memory is eliminated by storing and shipping the pump in the storage position. Precision occlusivity adjustment during procedure is provided by structure for controlling the advancement of the rotor assembly to a selected operation position.

The novel construction of the pump of the present invention, having a preformed pump chamber or tube, also facilitates other advantages and features. For example, the pump of the present invention is compact. Thus, the pump is easy to store and handle, and may be placed immediately proximate a patient during medical procedures, e.g., between the patient's legs. Proximal placement of the pump also reduces the amount of additional blood supply required for priming secondary tubes to and from the pump prior to performing a medical procedure. Thus, it reduces the set up time required prior to performing the procedure. The compact size also reduces the radial size of the rotor assembly, which reduces torque requirements and power consumption of the pump motor. Thus, the pump of the present invention requires a smaller motor and power supply, which may be portable. The preformed tube, having a compression portion formed at its inlet side, also substantially eliminates hydroshock and associated thrombus. These advantages and features of the present invention have utility in all extracorporeal procedures, and have particular utility in emergency medical procedures.

These and other advantages and features of the present invention readily will be apparent to those skilled in the art from the following detailed description of the present invention and the accompanying drawings.

BRIEF DESCRIPTION OF THE DRAWINGS

FIG. 1 is a partially exploded or disassembled view of a first embodiment of a roller pump according to the present invention, shown partially in cross-section, to illustrate a disposable pump housing and preformed tube, and a reusable rotor assembly having a single drive roller with adjustable occlusivity and a counter-balance support.

FIG. 3 is a cross-sectional view of a worm gear mechanism of the occlusivity adjusting mechanism, taken along line 3—3 of FIG. 1.

FIGS. 4A and 4B are cross-Sectional views of the cam shaft operated occlusivity adjusting mechanism, taken along line 4—4 of FIG. 1, respectively illustrating the mechanism in the closed (non-occluded) and open (occluded) positions.

FIG. 9 is an end view of a rotor shaft of the rotor assembly for the roller pump of FIG. 8.

FIG. 10 is a plan view of a drive roller shaft for the roller pump of FIG. 8, illustrating an eccentric axes configuration for effecting occlusivity control.

FIG. 11 is an end view of the drive roller shaft of FIG. 10.

FIG. 12 is an end view of the single roller pump of FIG. 8.

DETAILED DESCRIPTION OF THE PREFERRED EMBODIMENTS

Figure 2:
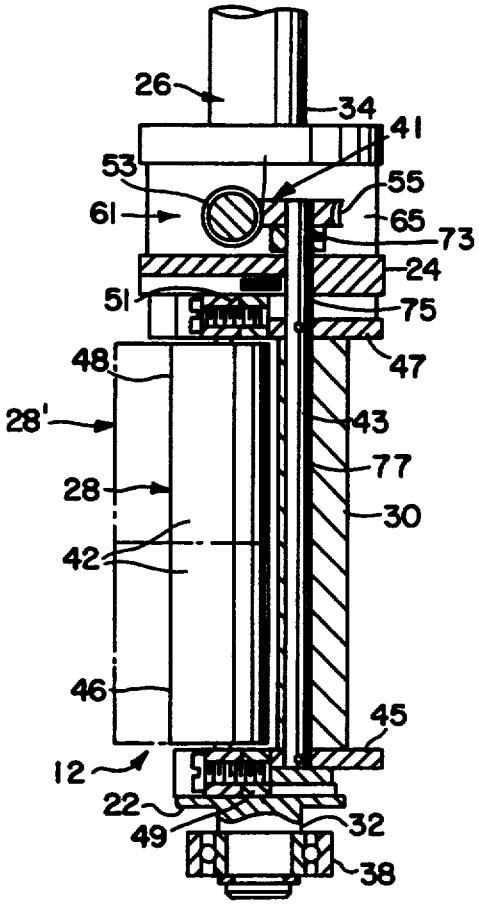
FIG. 2 is a partial plan view of the rotor assembly of FIG. 1, shown in partial cross-section to illustrate a cam shaft operated adjusting mechanism.

Referring now to the drawings, wherein like reference numerals designate like or corresponding parts throughout, three embodiments of a single roller-blood pump of the present invention are illustrated. Each of these embodiments includes a generally cylindrical housing, a pump chamber or tube arranged in a helix in the cylindrical housing, and a rotor assembly including a single drive roller for progressively occluding the tube to pump fluid therethrough by peristaltic action.

EMBODIMENT 1

FIGS. 1 to 7 illustrate a first embodiment of a single roller blood pump according to the present invention. As shown therein, a blood pump 10 generally includes a rotor assembly 12, a housing 14, and a pump chamber or tube 16. Rotor assembly 12 may be driven by a conventional motor (not shown), and the output of blood pump 10 may be input to an oxygenator (not shown) for an extracoporeal procedure.

Referring now to FIG. 1, blood pump 10 is illustrated in a partially exploded or disassembled view. As shown therein, rotor assembly 12 generally includes a head plate 22, a base plate 24, a rotorshaft 26, a drive roller 28 and a counter-balance support 30. It will be appreciated that head plate 22, base plate 24 and counter-balance support 30 may be formed as a single element to provide greater structural rigidity. As described in greater detail below, drive roller 28 is rotatably supported between head plate 22 and base plate 24.

Rotor assembly 12 is rotatable about rotor shaft 26. More specifically, rotor shaft 26 includes a head axle 32 disposed on head plate 22, and a base axle 34 coaxially disposed on base plate 24. Of course, head, axle 32 and base axle 34 may be integrally formed with head plate 22 and base plate 24, respectively, for greater structural rigidity.

Rotor assembly 12 is rotatably mountable in housing 14. Specifically, housing 14 is a generally cylindrical shell and includes a primary housing portion 15 and a cap 17. A stepped annular recess 36 is provided coaxially in a base portion 19 of the primary housing portion 15, for receiving a head axle bearing 38 (see also FIG. 2) of rotor assembly 12. Similarly, a stepped annular recess 37, including a base axle bearing 39, is provided coaxially in cap 17, for receiving base axle 34 of rotor assembly 12. Primary housing portion 15 and cap 17 respectively include a complementary lip 21 and flange 23, which provide a means for securely fastening housing portion 15 and cap 17 together. Of course, other conventional fastening means may be used. Thus, as will be readily appreciated, when assembled, rotor assembly 12 is mounted within housing 14 for rotation about an axis common to each of rotor assembly 12 and housing 14, including stepped annular recesses 36, 37.

The occlusivity of tube 16 by drive roller 28 is controlled by varying the radial extension of drive roller 28. Specifically, rotor assembly 12 is provided with an occlusivity adjusting mechanism. As shown in FIG. 2, the occlusivity adjusting mechanism generally includes a manually operated transmission 41, a cam shaft 43, a head cam 45, a base cam 47, a head slider 49 and a base slider 51.

Referring specifically to FIGS. 2 and 3, transmission 41 includes a driving worm gear 53, a follower worm gear 55, and an adjusting knob 57. Driving worm gear 53 is coaxially mounted on a driving worm gear shaft 59 within an open gear chamber 61 of rotor shaft 26, and secured for rotation about gear shaft 59 by a pin 63, such that the axial ends of worm gear 53 are located between chamber walls 65, 67. Adjusting knob 57 is fixed at an axial end of gear shaft 59 and is manually rotatable for driving transmission 41.

Those skilled in the art will appreciate that a worm gear generally is self-stopping. In other words, once the gear is manually set at a position, it tends to remain in that position. However, it also is known that vibration can effect gear movement. Accordingly, means for setting the worm gear, such as a set screw, may be provided to insure that a selected occlusivity setting is not inadvertently changed.

In the present embodiment, a set screw 69 is threadably engaged in a counterbore 71 of rotor shaft 26, so that it advances and withdraws along a common axis with gear shaft 59, and engages an axial end of gear shaft 59 when substantially advanced through counterbore 71. In this manner, when set screw 69 engages the axial end of gear shaft 59, inadvertent rotation of worm gear 53 is prevented by frictional contact therewith.

Referring again to FIG. 2, follower worm gear 55 is fixed coaxially at an axial end of gear shaft 59 by a screw 73. Cam shaft 43 is rotatably mounted through a first recess 75 in rotor shaft 26, and a second recess 77 in counter-balance support 30. Therefore, manual rotation of adjusting knob 57 drives worm gear 53, which in turn drives follower worm gear 55 and cam shaft 43. Finally, head cam 45 and base cam 47 coaxially are fixed at respective axial end portions of cam shaft 43, e.g., by pins, so that rotation of cam shaft 43 effects simultaneous, parallel rotation of head cam 45 and base cam 47.

Head cam 45 and base cam 47 are arranged to change the occlusivity setting of roller 28 by translating roller 28 in a radial direction. Specifically, as will be discussed in greater detail below, roller 28 is rotatably supported on a roller shaft 40 supported between head slider 49 and base slider 51. Rotation of cam shaft 43 causes simultaneous and parallel rotation of head cam 45 and base cam 47, and the rises of head cam 45 and base cam 47 in turn respectively engage head slider-49 and base slider 51, to change the occlusivity setting by simultaneously translating head slider 49 and base slider 51 (and thus roller shaft 40 and roller 28 in a radial direction. Head slider 49 and base slider 51 (and thus drive roller 28) may be biased against head cam 45 and base cam 47, i.e., in a radially inward direction, by conventional springs 89.

For example, the operation of base cam 47 specifically is shown in FIGS. 4A and 4B. As shown therein, base slider 51 slides in a radial direction within rails 79 of rotor shaft 26, and supports roller shaft 46 for parallel translation in a radial direction. In FIG. 4A, base cam 47 is shown in a closed setting position, and base slider 51 is shown in a withdrawn, non-occluding position (see, e.g., roller 28 in FIG. 2). In FIG. 4B, base cam 47 is shown in an open setting position, and base slider 51 is shown in a fully extended, occluding position (see, e.g., phantom roller 28 in FIG. 2). Of course, since base cam 47 has a gradual rise, and since transmission 41 of the occlusivity setting mechanism can be set at any position within its range of movement, the degree of rotation of base cam 47 can be selected and maintained with a high degree of accuracy at any position within its range, i.e., between the fully withdrawn position (FIG. 4A) and the fully extended position (FIG. 4B).

To ensure a gradual transition of the occlusivity setting during operation, the occlusivity setting mechanism may be arranged for rotation in a particular direction. Specifically, as shown in FIGS. 4A and 4B, base slider 51 may be provided with a chamfered edge 81. Thus, if the mechanism is operated so that base cam 47 is rotated in a clockwise direction, as shown by the arrow in FIGS. 4A and 4B, base slider 51 engages the rise of base cam 47 and is gradually translated in the radial direction. On the other hand, if the mechanism is operated so that base cam 47 is rotated in a counterclockwise direction, the flat of base cam 47 will engage chamfered edge 81 of base slider 51. Thus, it will be appreciated that this arrangement provides a reference setting, where the flat of base cam 47 is in engagement with chamfered edge 81, i.e., a non-occluding setting. Moreover, in this manner, an operator quickly can locate a reference setting, e.g., for emergency procedures, to remove a rotor assembly from a first housing and insert it in a second housing for another procedure.

Figure 5:
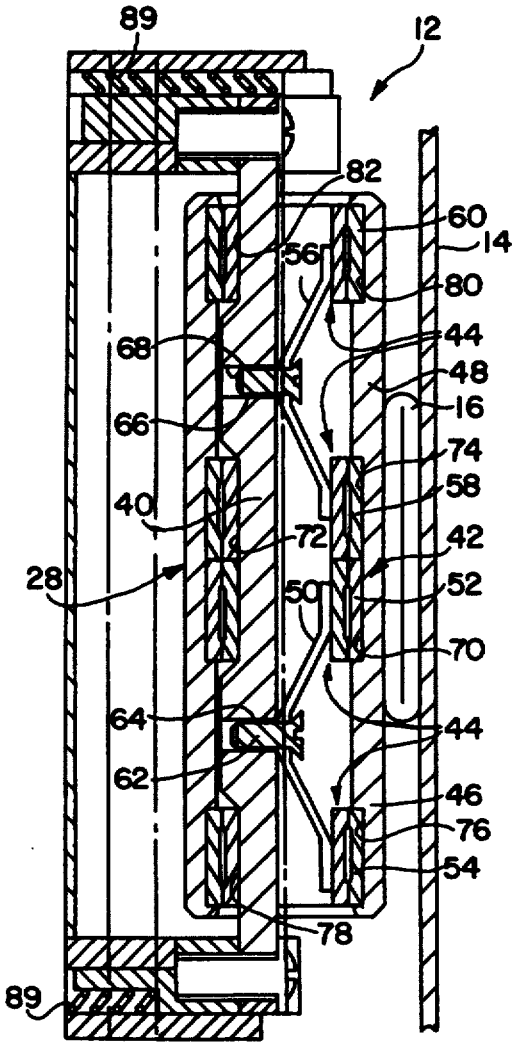
FIG. 5 is a longitudinal cross-sectional view of the drive roller of FIG. 1, including structure for adjusting occlusivity, and for preventing overpressurization.

Referring now to FIG. 5, as shown in longitudinal cross-section, drive roller 28 generally includes a roller shaft 40, a roller body 42, and a drive roller bearing assembly 44. Roller body 42 includes a first roller member 46 and a second roller member 48. Likewise, drive roller bearing assembly 44 includes a first bearing spring 50, for supporting first inner bearings 52 and first outer bearings 54, and a second bearing spring 56, for supporting second inner bearings 58 and second outer bearings 60. A first bearing spring screw 62 secures first bearing spring 50 to roller shaft 40 at first threaded bore 64, and a second bearing spring screw 66 secures second bearing spring 56 to roller shaft 40 at second threaded bore 68. First inner bearings 52 are captured in first inner roller recess 70, and generally seat in common inner shaft recess 72. Likewise, second inner bearings 58 are captured in second inner roller recess 74, and generally seat in common inner shaft recess 72. First outer bearings 54 are captured in first outer roller recess 76, and generally seat in first outer shaft recess 78. Likewise, second outer bearings 60 are captured in second outer roller recess 80, and generally seat in second outer shaft recess 82. Thus, it will be appreciated that first roller member 46 and second roller member 48 independently are supported for rotation about roller shaft 40. The axis of rotation for each roller member may vary in a plane formed in a radial direction of rotor assembly 12, and is biased in the outward radial direction of rotor assembly 12. Of course, the maximum radial extension of each axis corresponds to a position where inner and outer bearings 52, 54, 58, and 60 are seated in respective shaft recesses 72, 78, and 82. As discussed in greater detail below, this design provides an independent pressure release mechanism for each of first roller member 46 and second roller member 48, to prevent over pressurization, e.g., if fluid flow in the tube is inhibited by clamping of the tube downstream of the pump.

Figure 6:
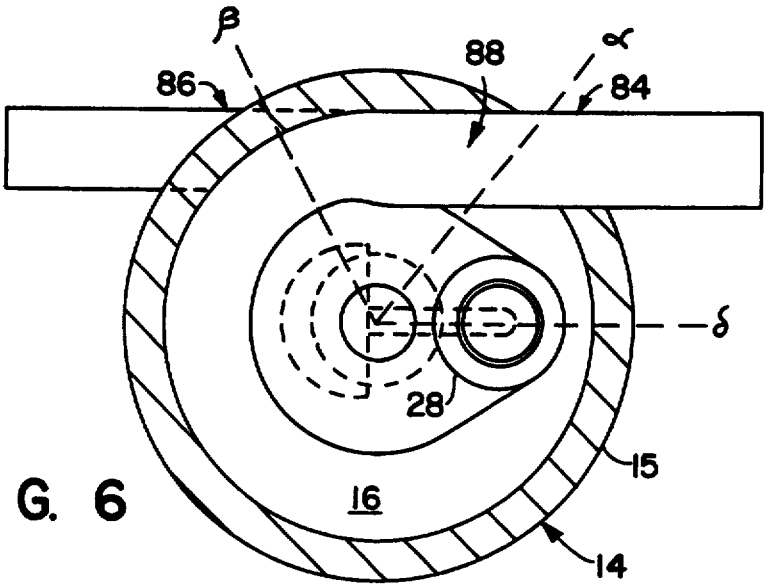
FIG. 6 is a top plan view of the assembled roller pump of FIG. 1.

Referring now to FIG. 6, the pump of the first embodiment is shown in a top schematic view. The pump chamber is formed by flexible tube 16 having an inlet 84, an outlet 86 and a compression portion 88 formed at inlet 84. Tube 16 is arranged contiguous with housing 14, and fluid is pumped therethrough from inlet 84 to outlet 86 by advancing drive roller 28 along tube 16 to progressively occlude it. As discussed in greater detail below, FIG. 6 also identifies designation angles $\alpha$, $\beta$ and $\delta$, which are provided as reference angles only, for explaining the operation of drive roller 28 and tube 16 of pump 10.

As best shown in FIGS. 1 and 6, tube 16 preferably is preformed with a D-shaped cross-section and arranged in a helical configuration with the flat side of the D-shaped cross-section contiguous with housing 14. It will be appreciated that this configuration substantially eliminates any "creep" or "walking" of tube 16 within housing 14 during operation. Thus, it substantially eliminates the risk of any crimping or buckling of tube 16 during operation, and greatly increases its reliability and efficiency during procedure. In some applications it may be desirable to affix the flat side of tube 16 to housing 14, e.g., by gluing, to eliminate any creep.

In the present embodiment, tube 16 is preformed in a helix with a D-shaped cross-section by a known thermosetting method. Specifically, tube 16 is composed of a thermoplastic material, such as polyvinylchloride (PVC), and is formed by pulling a standard PVC tube over a helical D-shaped mold, heating the tube to conform it to the mold, and cooling the tube to retain the helical D-shaped mold configuration. Of course, those skilled in the art readily will appreciate alternative materials and methods suitable for a variety of applications.

Figure 7A:
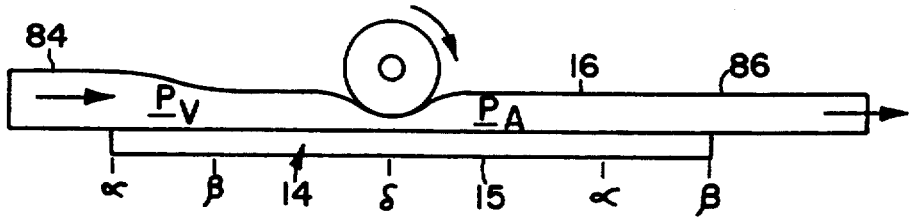
FIGS. 7A to 7C are linear schematic representations of the roller and tube of the pump in FIG. 1, illustrating operation of a compression portion at the tube inlet.
Figure 7B:
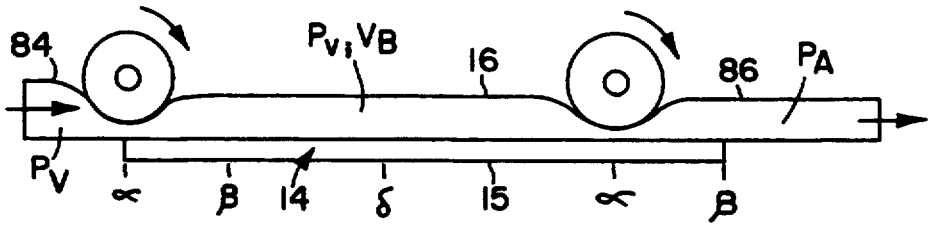
Figure 7C:
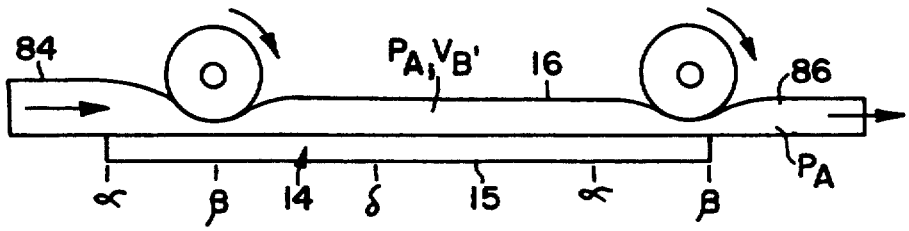

Referring now to FIGS. 7A to 7C, the operation of drive roller 28 and tube 16 of pump 10 schematically is shown in a linear configuration. Specifically, the circumferencial interface of tube 16 and housing 14 of FIG. 6 is represented linearly, with the radial designation angles $\alpha$, $\beta$ and $\delta$ of FIG. 6 corresponding to the indices of the horizontal axis in FIGS. 7A to 7C. More particularly, FIG. 7A schematically illustrates drive roller 28 advancing along tube 16 at radial angle $\delta$ of FIG. 6. FIG. 7B schematically illustrates drive roller 28 advancing along tube 16 at radial angle $\alpha$ of FIG. 6, wherein first roller member 46 is advancing along tube 16 at inlet 84, and second roller member 48 is advancing along tube 16 at outlet 86. Likewise, FIG. 7C schematically illustrates drive roller 28 advancing along tube 16 at radial angle $\beta$ of FIG. 6, wherein first roller member 46 is advancing along tube 16 at inlet 84 and second roller member 48 is advancing along tube 16 at outlet 86. It will be appreciated that tube 16 overlaps itself from designation angle $\alpha$ to designation angle $\beta$, i.e., from inlet 84 to outlet 86, to form compression portion 88 at inlet 84.

Referring again to FIG. 7A, as in conventional single roller blood pumps, inlet 84 is in fluid communication with the patient's vein, and outlet 86 is in fluid communication with the patient's artery. Thus, during each cycle of blood pump 10, blood in tube 16 preceding drive roller 28, i.e., between drive roller 28 and outlet 86 (downstream), generally is maintained at the relatively high arterial pressure $P_A$. At the same time, blood drawn through inlet 84 into the portion of tube 16 succeeding drive roller 28 generally is maintained at a relatively low pressure, e.g., at venous pressure $P_V$, or at subatmospheric pressure.

Referring again to FIG. 7B, as drive roller 28 passes designation angle $\alpha$ it occludes tube 16 both at inlet 84, and at outlet 86. More particularly, first roller member 46 occludes tube 16 at inlet 84 and second roller member 48 occludes tube 16 at outlet 86. Accordingly, the blood pressure upstream of first roller member 46 is venous pressure $V_P$, and the blood pressure at outlet 86, downstream of second roller member 48, is arterial pressure $P_A$.

The blood pressure in tube 16 between first roller member 46 and second roller member 48, which was in fluid communication with the patient's vein immediately prior to inlet 84 being occluded by first roller member 46, also initially is at $P_V$. More specifically, at the beginning of the pump cycle, when first roller member 46 of drive roller 28 first occludes tube 16 at inlet 84, a volume of blood $V_B$ is captured within tube 16 between first roller member 46 and second roller member 48. It will be appreciated that $V_B$ equals the volume of tube 16 therebetween, including a differential volume associated with compression portion 88, $\Delta V_{CP}$, because compression portion 88 has a greater volume per unit length than the remaining portion of tube 16.

Referring again to FIG. 7C, as drive roller 28 passes designation angle $\beta$, it still occludes tube 16 both at inlet 84 and outlet 86. As in FIG. 7B, the blood pressure at inlet 84, i.e., upstream of first roller member 46, is at venous pressure $P_V$, and the blood pressure at outlet 86, i.e., downstream of second roller member 48, is at arterial pressure $P_A$.

However, the blood pressure in tube 16 between first roller member 46 and second roller member 48 now has increased to arterial pressure $P_A$, prior to being opened to fluid communication with the artery at outlet 86. Specifically, a gradual increase in pressure from $P_V$ to $P_A$ is effected as a result of a gradual compression of the fluid in tube 16 due to a gradual decrease in the volume of tube 16 between designation angle $\alpha$ and designation angle $\beta$. More specifically, the volume of tube 16 between first roller member 46 and second roller member 48, and thus the volume of blood $V_B$, gradually has decreased to $V_B' = V_B - \Delta V_{CP}$. It will be appreciated that the change in volume, i.e., $\Delta V_{CP}$, required to elevate the blood pressure is relatively small because fluid is highly incompressible.

Therefore, it will be appreciated that pump 10 overcomes drawbacks of the prior art. Initially, as described above, the blood in tube 16 between first roller member 46 and second roller member 48 is compressed gradually. Specifically, since the fluid captured in tube 16 between first roller member 46 and second roller member 48 simultaneously is being compressed and advanced by peristaltic action, compression of the fluid due to a decrease in the volume of tube 16 is distributed over the entire volume of fluid. Thus, localized compression or hydroshock, and associated thrombus, substantially is eliminated.

Pump 10 also utilizes a preformed tube and a rotor assembly having a single drive roller. This combination provides a compact pump structure. Moreover, the single drive roller requires a relatively small driving torque. Accordingly, pump 10 can operate with a small, portable, battery driven motor.

Pump 10 also provides a simple mechanism for storage without causing tube pinch or occlusion memory. More particularly, during storage drive roller 28 may be radially withdrawn on head slider 49 and base slider 51 to a storage position that does not occlude tube 16. Then, drive roller 28 may be radially extended to an occlusion position for operation. Moreover, this mechanism also allows a physician to make fine adjustments to the occlusivity, to accurately control the flow of blood, etc. Finally, pump 10 provides a pump mechanism in which the rotor assembly is readily reusable. The motor and rotor assembly thus may be stored together and simply inserted into a new disposable housing and tube assembly for each procedure, and the occlusivity control mechanism allows the rotor assembly to be adjusted for any minor variations in the sizes of housing 14 and tube 16.

EMBODIMENT 2

Figure 8:
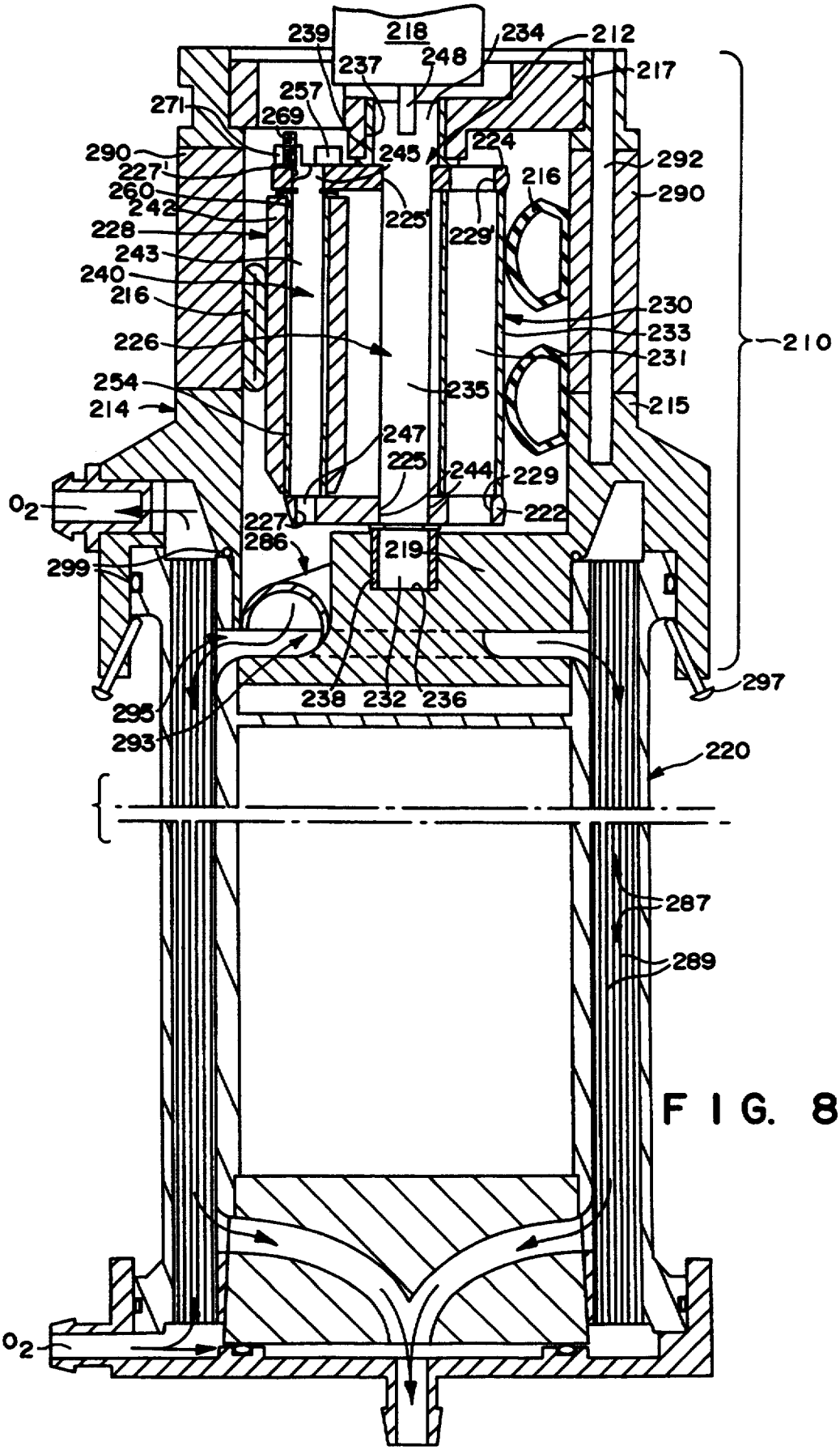
FIG. 8 is a longitudinal cross-sectional view of a second embodiment of a single roller pump according to the present invention, together with an oxygenator for use as a heart/lung machine.

FIGS. 8 to 13 illustrate a second embodiment of a single roller blood pump according to the present invention. As shown in FIG. 8, blood pump 210 generally includes a rotor assembly 212, a housing 214, and a pump chamber or tube 216. Rotor assembly 212 includes a head plate 222, a base plate 224, a rotor shaft 226, a drive roller 228 and a counter-balance support roller 230. Drive roller 228 includes a roller shaft 240 and a roller body 242, and support roller 230 includes a support shaft 231 and a sleeve 233. Rotor assembly 212 is arranged for rotation about an axis of rotor shaft 226, and is driven by a conventional motor 218. Pump chamber 216 of pump 210 is connected to an oxygenator 220.

As in the first embodiment, rotor assembly 212 is rotatably mountable in housing 214. Specifically, housing 214 includes a primary housing portion 215 and a cap 217. A recess 236 is provided coaxially in a base portion 219 of the primary housing portion 215, for receiving a head axle bearing 238 of rotor assembly 212. Similarly, a recess 237 is provided coaxially in cap 217, for receiving a base axle bearing 239 of rotor assembly 21.2. Primary housing portion 215 and cap 217 also are securely fastened together. For example, in the present embodiment, primary housing portion 215 and cap 217 are glued together. Alternatively, these parts may be provided with complementary fastening means, such as complementary threads or bayonet mounts. Of course, other conventional fastening means readily will be apparent to those skilled in the art. Thus, when assembled, rotor assembly 212 is mounted for rotation in housing 214 about a common axis, and may be rotatably driven by motor 218.

Referring now to FIGS. 8 and 9, rotor shaft 226 includes an axle head 232, an axle base 234 and a shaft body 235. As shown in FIG. 9, axle head 232 and axle base 234 are cylindrical and coaxial, and have respective circular cross-sections of radius $r_H$ and $r_B$, where $r_B > r_H$. Shaft body 235 also is generally cylindrical and coaxial, and has a circular cross-section of radius $r_S = r_B$. However, in cross-section, shaft body 235 is truncated along chord lines "C" arranged on radially opposite sides at a radius equal to $r_H$, to form a pair of flat drive surfaces 244. Also, axle base 234 is provided with a rectangular shaped cross-channel recess 246, which is arranged for coaxially engaging a drive shaft 248 of motor 218.

As best shown in FIGS. 8 and 13, head plate 222 and base plate 224 of rotor assembly 212 generally are six-sided disks. Head plate 222 includes a center recess 225 having a complementary truncated circular cross-section for receiving rotor shaft 226, a drive roller recess 227 for receiving roller shaft 240, and a support roller recess 229 for receiving support shaft 231. Likewise, base plate 224 includes a center recess 225' having a complementary truncated circular cross-section for receiving rotor shaft 226, a drive roller recess 227' for receiving roller shaft 240, and a support roller recess 229' for receiving support shaft 231.

Rotor assembly 212 is assembled by arranging head plate 222 and base plate 224 in parallel, to support each of rotor shaft 226, drive roller 228 and support roller 230 therebetween. More specifically, sleeve 233 first is slid over support shaft 231 to form support roller 230. Support shaft 231 then is threaded into respective support roller recesses 229, 229' of head plate 222 and base plate 224 to secure these elements in a parallel, mirror-image orientation. It will be appreciated that assembly of these elements can be facilitated by providing reverse or opposite pitch threading (e.g. clockwise threads v. counterclockwise threads) on opposite ends of support shaft 231, together with corresponding reverse pitch threading in respective head plate 222 and base plate 224.

After assembly of the base plate 224, head plate 222 and support roller 230, rotor shaft 226 and drive roller 228 may be added to the assembly. More particularly, rotor shaft 226 is inserted through respective center recesses 225', 225 of base plate 224 and head plate 222. Upon insertion thereof, rotor shaft 226 may be secured between head plate 222 and base plate 224 by conventional means, such as a snap ring provided in an annular recess of rotor shaft 226 (see, FIG. 8).

Drive roller 228 is assembled by sequentially inserting roller shaft 240 through drive roller recess 227' of base plate 224, drive roller body 242, and drive roller recess 227 of head plate 222. Of course, prior to such insertion, head roller bearings 254 and base roller bearings 260 are inserted into respective ends of roller body 242, and the assembled roller body 242, base bearings 260, and head bearings 254 are disposed in-line between base plate 224 and head plate 222. Upon insertion, drive roller 228 also may be secured between head plate 222 and base plate 224 by conventional means, such as a snap ring provided in an annular recess of roller shaft 240 (see, FIG. 8).

Referring to FIGS. 10 and 11, drive roller shaft 240 includes a roller axle 243, a registration axle 245, and a pivot axle 247. Each of roller axle 243, registration axle 245, and pivot axle 247 are cylindrical, having a circular cross-section. Specifically, registration axle 245 has a radius $r_r$, roller axle 243 has a radius $r_R$, and pivot axle 247 has a radius $r_p$, where $r_r > r_R > r_p$. Roller shaft 240 also has a manual adjusting knob 257, which forms a flange at one end of registration axle 245. Adjusting knob 257 includes a registration adjusting channel 250, which preferably has a cross-section for receiving a screwdriver, or other manual adjusting device, for rotating roller shaft 240, to adjust and set the occlusivity of drive roller 228.

Referring particularly to FIG. 11, the respective axes of roller axle 243, registration axle 245, and pivot axle 247 are arranged to provide means for varying the occlusivity. More specifically, the axis of roller axle 243 is coplanar and parallel to, but offset from, the axes of registration axle 245 and pivot axle 247. Those skilled in the art readily will appreciate that this eccentric arrangement of axes functions as a cam, so that rotation of adjusting knob 257 adjusts the radial extension of roller axle 243 (and thus of drive roller 228) from the common axis of the rotor assembly 212 and housing 214. In this manner, the occlusivity of tube 216 can be accurately adjusted.

Once adjusted to a selected occlusivity setting, the setting may be maintained using a set screw 269. Specifically, adjusting knob 257 may be provided with a registration bore 271 for receiving set screw 269. Referring particularly to FIG. 11, registration bore 271 preferably is arranged with its axis parallel to and coplanar with the axes of roller axle 243, registration axle 245 and pivot axle 247, and most preferably is arranged tangent to registration axle 245. In this manner, it will be appreciated that, when set screw 269 is advanced in registration bore 271, it engages base plate 224, to register and set roller shaft 240 relative to base plate 224.

Figure 13A:
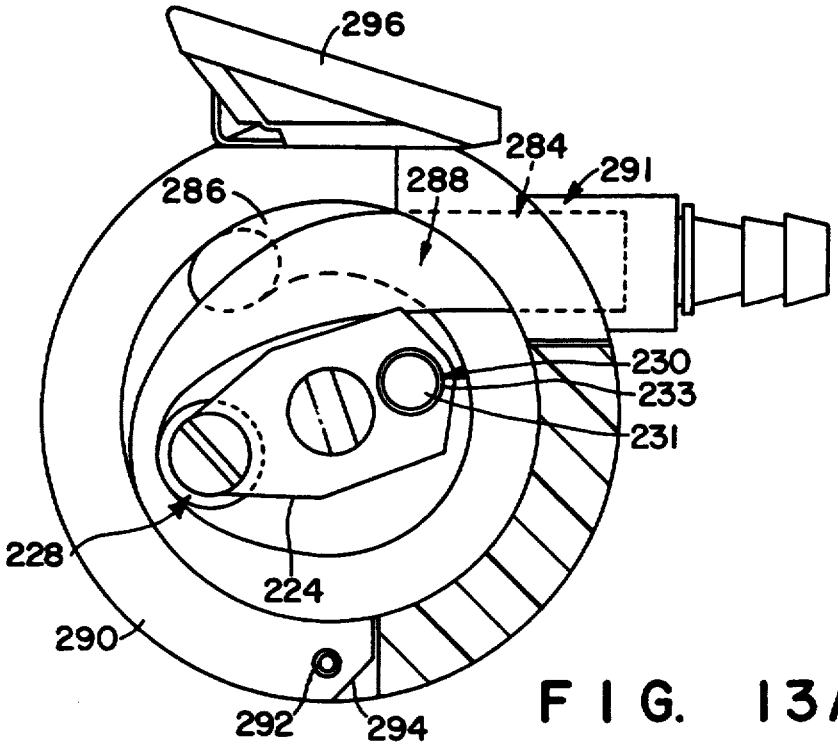
FIGS. 13A and 13B are cross-sectional views of the roller pump of FIG. 8, respectively illustrating a storage door in a closed and open position.
Figure 13B:
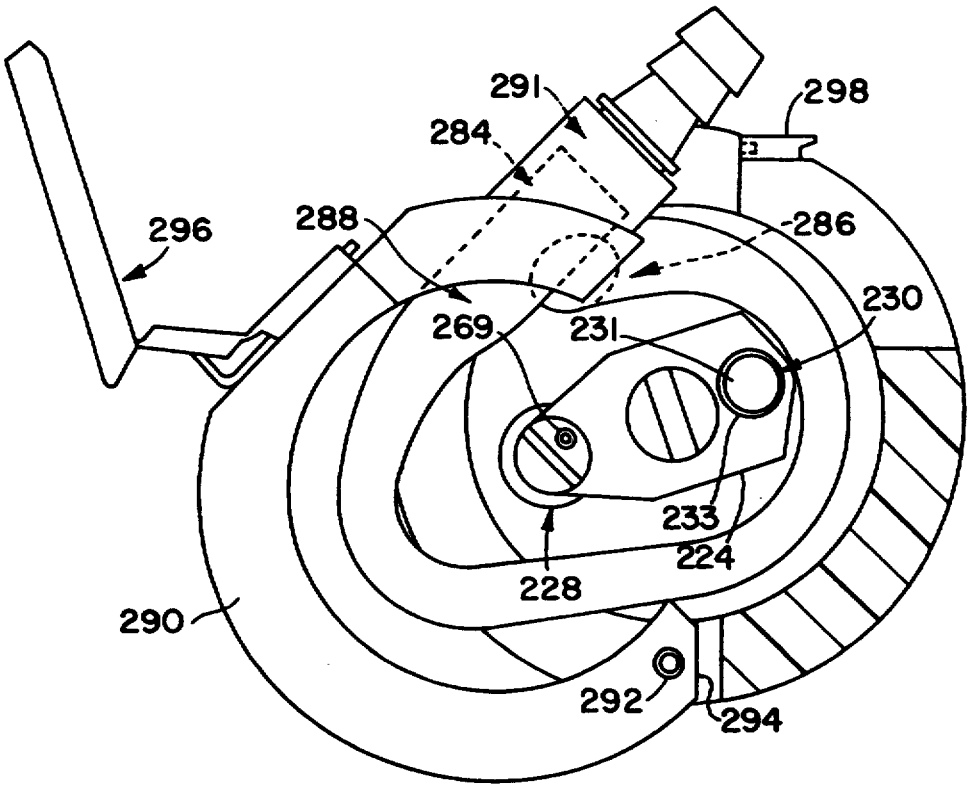

FIG. 12 is an end view, and FIGS. 13A and 13B are cross-sectional views of the roller pump 210 of FIG. 8. As shown therein, primary housing portion 215 includes a door 290 forming an arcuate portion of the sidewall of pump 210. One end of door 290 is rotatably attached to the sidewall by a hinge pin 292, and is provided with a chamfered edge 294 to permit unobstructed rotation thereof. The other end of door 290 is provided with a latch 296, which releasably engages a complementary catch 298 (see, FIG. 13B) fixed to the exterior sidewall of primary housing portion 215, to secure door 290 in a closed position. Door 290 also has an inlet port 291, located at the latter end thereof, and arranged to form a fluid channel from the interior to the exterior of housing 214 along a tangent of the sidewall, such that a continuous surface is provided for compression portion 288 of tube 216. Of course, as in the prior embodiment, tube 216 is helically coiled through housing 214,, and outlet 286 of tube 216 is received in an exit port 293 of base portion 219, which in turn is arranged in fluid communication with an inlet port 295 of oxygenator 220. Finally, oxygenator 220 is attached in a fluid-tight manner to base portion 219 of housing 214 using conventional structure, such as retaining screws 297 and O-rings 299.

The operation of pump 210 is substantially similar to the operation of pump 10 of the first embodiment. Referring to FIGS. 8 and 13A, when door 290 is closed, it forms a continuous interior surface with the sidewall of primary housing portion 215. Rotor assembly 212 is rotatably driven to progressively occlude tube 216, which is of similar size and configuration as tube 16 of the previous embodiment, to pump fluid from inlet 284 to outlet 286 by peristaltic action.

Of course, the helical turn of pump chamber (tube) 216 may be greater than about 380°. For example, as shown in FIG. 8, the helical turn of tube 216 continues for about another 180° to connect to oxygenator 220 at outlet 286. However, as those skilled in the art readily will appreciate, the operable portion of pump chamber (tube) 216, i.e., where tube 216 is occluded by drive roller 228, is about a 380° turn.

In the present embodiment, counter-balance support roller 230 of rotor assembly 212 assists in the efficiency of the motor by balancing rotor assembly 212, and by stabilizing tube 216 during operation. Specifically, support roller 230 provides a rotational inertia approximately equal to that of drive roller 228, whereby support roller 230 and drive roller 228 are dynamically balanced. Also, as best shown in FIG. 8, support roller 230 is arranged to rotate at a radius from the common axis of pump 210, such that when tube 216 is contiguous with the sidewall of primary housing portion 215, support roller 230 can rotate within housing 214 with minimal clearance between support roller 230 and tube 216.

Of course, during operation, tube 216 may not always be contiguous with the sidewall of primary housing portion 215. For example, in operation, as drive roller 228 rotates and occludes tube 216, it tends to pull tube 216 radially inward ( see, e.g. , FIG. 13A) . As noted above, in some applications this "walking" or "creep" can be prevented by gluing tube 216 to the sidewall of primary housing portion 215. However, in the present embodiment, gluing may not be practicable because door 290 is located, at least in part, at a contact position of tube 216.

Accordingly, support roller 230 is provided with a sleeve 233 composed of a low friction material, such as polytetrafloroethylene (teflon) or the like, so that support roller 230 can engage and support tube 216 at its intended radius without occluding it or causing substantial friction or wear.

Referring again to FIG. 8, pump 210 and oxygenator 220 may be manufactured and shipped individually or as a unit. Moreover, when provided as a unit, they may be either attachable (as shown) or permanently attached as an integral unit, as readily will be apparent to those skilled in the art.

Oxygenators and their operation are well known. Accordingly, a detailed description of the operation of oxygenator 220 is omitted. However, oxygenator 220 generally includes an oxygenation chamber 287, including an oxygen transfer membrane 289. Oxygen depleted blood, e.g., from a patient, is pumped through chamber 287 on one side of membrane 289, and oxygen is pumped through chamber 287 on the other side of membrane 289, under conditions such that oxygen is transferred across membrane 289 to, and absorbed by, blood in chamber 287. This oxygenated blood then may be returned to the patient.

Referring to FIG. 13B, pump 210 has particular utility in that it may be shipped or stored assembled ready for use without causing an occlusion memory. Specifically, door 290 can be opened to a storage position in which tube 216 is not confined within housing 14 by door 290, but is permitted to extend, at least in part, through the doorway to the exterior of housing 214. The rotor assembly 212 then may be rotated so that drive roller 228 is adjacent open door 290 and tube 216, but not occluding tube 216. Moreover, as discussed in detail above, counter-balance support roller 230 is arranged at a radial distance that stabilizes tube 216 against housing 214, but does not occlude it. Accordingly, it will be appreciated that when door 290 is shipped or stored in this storage position, tube 216 will not be occluded, and will not retain an occlusion memory when later operated.

Pump 210 also overcomes other drawbacks of known roller pumps. For example, in the present embodiment, the occlusivity setting can be set prior to use, e.g., during manufacture or preparatory to emergency procedures, and the pump can then be stored in a sterile environment for later use without time-consuming set-up procedures.

Finally, since pump 210 includes a preformed tube 216, it will be appreciated that pump 210 also provides other advantages over known pumps, as described in detail with respect to the prior embodiment.

EMBODIMENT 3

Figure 14:
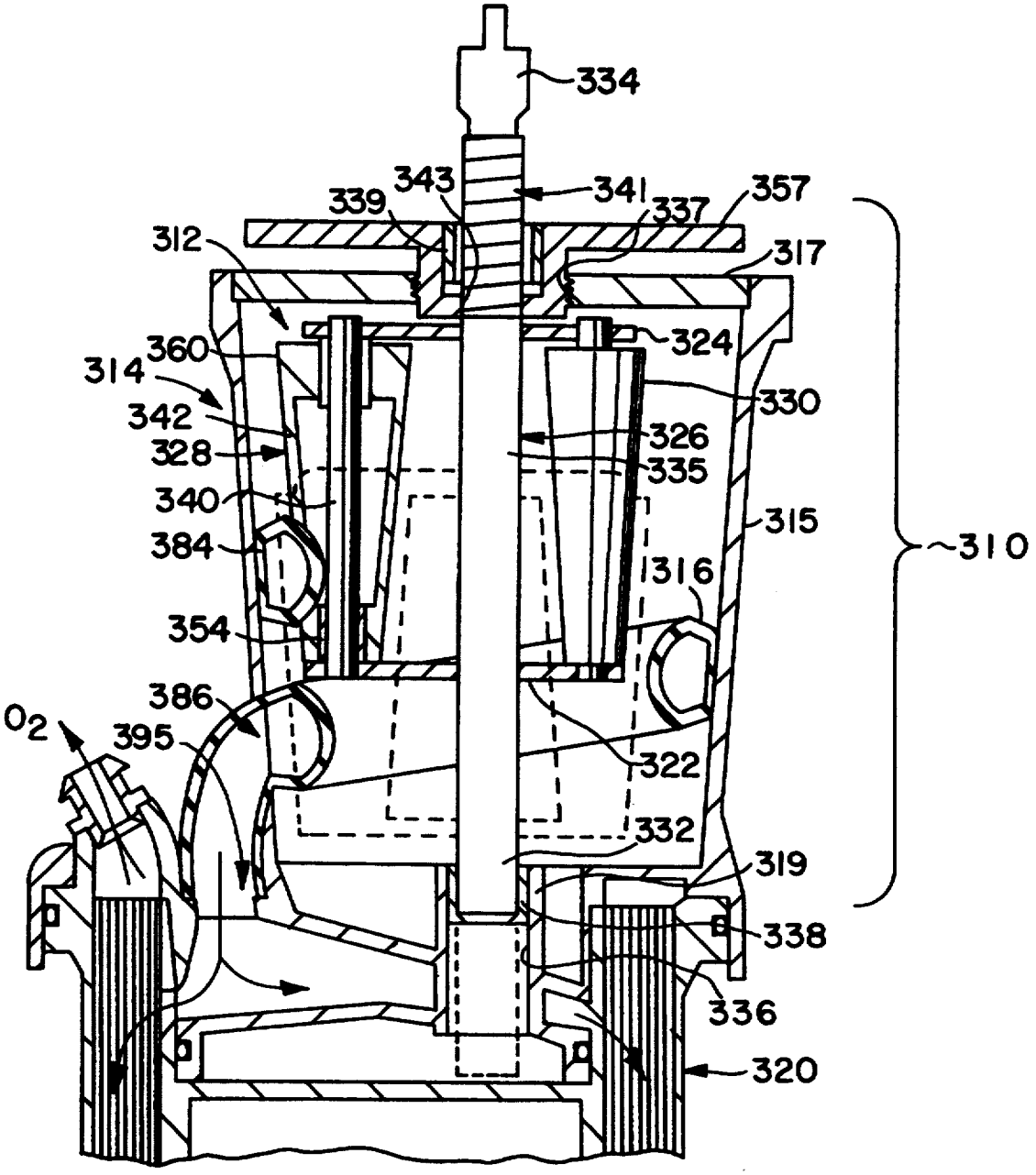
FIG. 14 is a longitudinal cross-sectional view of a third embodiment of a single roller pump according to the present invention, including a conical housing and rotor assembly, and a self-advancing rotor assembly, the rotor assembly advancing from a non-occluding storage position to a selected operating position having a highly accurate occlusivity setting.

FIG. 14 illustrates a third embodiment of a single roller pump of the present invention. More particularly, FIG. 14 illustrates in cross-section a single roller pump 310 including a rotor assembly 312, a housing 314, and a tube 316.

The overall design and operation of pump 310 is substantially similar to that of pump 210. Rotor assembly 312 may be driven by a conventional motor (not shown), and may be connected to an oxygenator 320 to form a heart/lung machine. However, in the present embodiment, although rotor assembly 312 and housing 314 generally are cylindrical, each has a conical taper. As discussed in greater detail below, this geometry and configuration provides a non-occlusive storage configuration and highly accurate occlusivity control using a rotor assembly 312 that is self-advancing.

Housing 314 is similar to housing 214, in that it includes a primary housing portion 315, a cap 317 and a base portion 319. As discussed in greater detail below, housing 314 is generally cylindrical, but has a conical taper from cap 317 (open end) to base portion 319 (closed end). A recess 336 coaxially is formed in base portion 319 for receiving head axle bearing 338 and axle head 332. A recess 337 coaxially is formed in cap 317 for receiving axle base 334, and cap 317 and primary housing portion 315 are provided with conventional means for attaching cap 317 to primary housing portion 315.

Tube 316 is substantially similar to tube 216, in that it has an inlet 384 arranged in fluid communication with an inlet port (not shown) of housing 314, and an outlet 386 arranged in fluid communication with an inlet port 395 of oxygenator 320. As in the prior embodiments, tube 316 is arranged in a helical turn, preferably is preformed in a helix having a D-shaped cross-section and a compression portion at inlet 384, and most preferably is arranged in about a 380° helical coil.

Rotor assembly 312 is substantially similar to rotor assembly 212, in that it includes a head plate 322, a base plate 324, a rotor shaft 326, a drive roller 328 and a counter-balance support roller 330. Head plate 322 and base plate 324 are substantially similar in design and function to head plate 222 and base plate 224, respectively.

Rotor shaft 326 is substantially similar to rotor shaft 226, in that it includes an axle head 332, an axle base 334 and a shaft body 335. Axle head 332 is substantially similar in design and function to axle head 232, although, as described in greater detail below, axle head 332 is elongated to allow rotor assembly 312 to translate or advance along the common axis of housing 314. Likewise, axle base 334 is similar in design and function to axle base 234. The design and function of shaft body 335 is substantially similar to shaft body 235, although, as described in greater detail below, an elongated, threaded portion 341 is provided on shaft body 335 adjacent base axle 334, for advancing rotor shaft 326 and rotor assembly 312 along the common axis of pump 310.

Counter-balance support roller 330 is similar in design and function to counter-balance support roller 230. However, counter-balance support roller 330 has a conical taper corresponding to the taper of housing 314. Accordingly, since rotor assembly 312 and housing 314 are coaxial, it will be appreciated that the radially outward surface of counter-balance support roller 330 is parallel to housing 314, i.e., the distance therebetween is constant. Moreover, as illustrated in phantom in FIG. 14, this parallel configuration is retained as rotor assembly 312 is advanced or translated along the common axis of pump 310.

Likewise, drive roller 328 is similar in design and function to drive roller 228, in that it includes a roller shaft 340, a roller body 342, head roller bearings 354 and base roller bearings 360. However, as discussed in greater detail below, in the present embodiment, occlusivity adjustment is achieved using a self-advancing rotor assembly 312. Thus, roller shaft 340 is a simple cylindrical axle structure, as shown in FIG. 14. Also, roller body 342 has a conical taper corresponding to the taper of housing 314. Accordingly, since rotor assembly 312 and housing 314 are coaxial, the radially outward surface of roller body 342 is parallel to housing 314, i.e., the distance therebetween is constant. Moreover, as illustrated in phantom in FIG. 14,-this parallel configuration is retained as rotor assembly 312 is advanced along the common axis of pump 30.

As noted above, in the present embodiment occlusion of tube 316 is achieved by translating or advancing rotor assembly 312 along the common axis of pump 310 from a storage position to an operative position (shown in phantom in FIG. 14). Occlusivity adjusting means is provided in this embodiment by a manual adjusting knob 357, which is threadably received in recess 337 of cap 317. Threaded portion 341 of rotor shaft 326 in turn is threadably received in a recess 343 coaxially formed in manual adjusting knob 357. Thus, it will be appreciated that rotor shaft 326 will be advanced or translated along the common axis of pump 310 when rotor shaft 326 is rotatably driven, e.g., by a motor (not shown). Moreover, when threaded portion 341 of rotor shaft 326 has advanced through threaded recess 343 of manual advancing knob 357, it will be appreciated that axle base 334 will be rotatably captured in base axle bearing 339, and axle head 332 will be rotatably captured in head axle bearing 338, so that rotor assembly 312 is rotatably mounted in housing 314.

Those skilled in the art also readily will appreciate that the occlusivity adjusting mechanism is a screw-nut arrangement, where the occlusivity setting of pump 310 may be adjusted by advancing or withdrawing manual adjusting knob 357. Specifically, by selecting the length and pitch of the complementary threads of manual adjusting knob 357 and recess 337 of cap 317, the range and precision of occlusivity control easily can be adjusted.

Precision occlusivity adjustment also is facilitated by the conical configuration of housing 314 and drive roller 328. Specifically, the conical angle of housing 314 and drive roller 328 may be selected to provide a desired ratio of relative radial (occlusivity) to longitudinal advancement of drive roller 328. The conical angle generally can vary within the range of about 1° to about 45°. Of course, the larger the angle, the less distance the rotor assembly must be advanced to engage and occlude the tube, and the more compact the pump may be made. For example, in the embodiment of FIG. 14, the conical angle is in the range of approximately 4° to 8°, preferably about 6°, which provides a longitudinal to radial advancement ratio of about 10:1. Those skilled in the art readily will be able to select the conical taper angle and pitch of the threads of recess 337 to achieve the optimal longitudinal to radial advancement ratio for a given application.

As noted above, rotor assembly 312 is advanced .along the common axis of pump 310 from a storage position to an operative position by rotatably driving rotor shaft 328 (and thus rotor assembly 312). Of course, in operation rotor assembly 312 is rotatably driven to pump fluid through tube 316 by peristaltic action. Thus, by selecting the pitch (direction) of threaded portion 341, rotor assembly 312 both may be advanced and operated in a single continuous operation. Moreover, it will be appreciated that, since the degree of occlusivity (e.g., radial advancement) will gradually increase as rotor assembly 312 advances from the storage position to the operative position, the fluid volume pumped through tube 316 of pump 310 also gradually will increase, as will the fluid pressure. In this manner, monitoring and selection of the pump volume and pressure is facilitated.

The conical taper of housing 314 also facilitates storage of pump 310. As generally shown in FIG. 14, in the storage position rotor assembly 312 is withdrawn to a position that is above the outlet port 386, and is rotated to an orientation within housing 314 wherein drive roller 328 is immediately adjacent inlet port 384 (illustrated in FIG. 14 as behind inlet 384), but not occlude tube 316. Accordingly, pump 310 may be shipped and stored assembled ready to use in a non-occluding storage position that permits simple, rapid set up and operation.

Finally since pump 310 includes a preformed helical tube 316, it will be appreciated that pump 310 also provides other advantages over known pumps, as detailed with respect to the prior embodiments.

Although the present invention has been exemplified in the above three embodiments, it is to be understood that these embodiments are illustrative only, and are not intended to limit the scope of the invention, which is defined by the following claims, including all equivalents, variants, modifications and alternatives that reasonably would occur to those skilled in the art.

What is claimed is:

1. A pump, comprising:

a housing forming a generally cylindrical chamber therein;

a rotor assembly having a drive roller, said rotor assembly being disposable within said housing and arranged for coaxial rotation within said chamber; and a flexible tube having a proximal end, a distal end and a wall forming a lumen therethrough, said tube being arranged in a helical turn and disposed within said chamber substantially contiguous with an interior surface of said housing, and having a tapered compression portion providing a variable volume per length in a direction from the proximal end to the distal end, wherein rotation of said rotor assembly rotatably advances said drive roller to progressively occlude said tube in a direction from the proximal end to the distal end to pump a fluid therethrough;

wherein said housing comprises an inlet port and an outlet port formed therein, each port providing a lumen for fluid communication from the interior of said housing to the exterior of said housing, wherein the proximal end of said tube is attached to said housing at said inlet port and is in fluid communication therewith, and wherein the distal end of said tube is attached to said housing at said outlet port and is in fluid communication therewith; and wherein said outlet port is provided in a base portion of said housing.

2. A pump, comprising:

a housing forming a generally cylindrical chamber therein, said housing including a primary housing portion, a cap attachable to said primary housing portion, and a door forming an arcuate portion of a sidewall of said primary housing portion, said arcuate portion being in a range of about 180° to 300°, an interior surface of said door being substantially continuous with an interior surface of said housing;

a rotor assembly including a drive roller, said rotor assembly being disposable within said housing and arranged for coaxial rotation within said chamber; and a flexible tube having a proximal end, a distal end and a wall forming a lumen therethrough, said tube being arranged in a helical turn and disposed within said chamber substantially contiguous with an interior surface of said housing, wherein a portion of said tube is contiguous with said door, and wherein rotation of said rotor assembly rotatably advances said drive roller to progressively occlude said tube in a direction from the proximal end to the distal end to pump a fluid therethrough.

3. The pump recited in claim 2, wherein said tube is composed of an elastomer.

4. The pump recited in claim 2, wherein said tube is composed of a thermoforming material, and is preformed by a thermoforming technique.

5. The pump recited in claim 2, wherein said helical turn is in the range of about 360° to 380°.

6. The pump recited in claim 2, wherein said helical turn is about 380°.

7. The pump recited in claim 2, wherein said housing comprises an inlet port and an outlet port formed therein, each port providing a lumen for fluid communication from the interior of said housing to the exterior of said housing, wherein the proximal end of said tube is attached to said housing at said inlet port and is in fluid communication therewith, and wherein the distal end of said tube is attached to said housing at said outlet port and is in fluid communication therewith.

8. The pump recited in claim 7, wherein said inlet port is provided in a radial sidewall of said housing.

9. The pump recited in claim 7, wherein said outlet port is provided in a base portion of the housing.

10. The pump recited in claim 2, further comprising means for adjusting an occlusivity of said tube.

11. The pump recited in claim 2, wherein said arcuate portion is approximately 270°.

12. The pump recited in claim 2, wherein an inlet port is located at an end of said arcuate portion, said inlet port having a lumen from the interior of said housing to the exterior of said housing, and wherein said tube is attached to said inlet port and is in fluid communication therewith.

13. The pump recited in claim 12, wherein said door includes a hinge pin located at the other end of said door, and wherein said door is rotatably attached to said housing by said hinge pin.

14. The pump recited in claim 2, wherein said door includes a hinge pin located at an end thereof and wherein said door is rotatably attached to said housing by said hinge pin.

15. A pump comprising:

a housing forming a generally cylindrical chamber therein, said housing including a primary housing portion, a cap attachable to said primary housing portion, and a door forming an arcuate portion of a sidewall of said primary housing portion, an interior surface of said door being substantially continuous with an interior surface of said housing;

a rotor assembly including a drive roller, said rotor assembly being disposable within said housing and arranged for coaxial rotation within said chamber, and wherein said rotor assembly further includes a head plate and a base plate, said drive roller includes a roller shaft and a roller body, said roller shaft including a registration axle, a roller axle and a pivot axle, said registration axle and said pivot axle being coaxial and rotatably supported by said head plate and said base plate, respectively, said roller body being coaxial with said roller axle and rotatably mounted thereon, the axis of said roller axle and said roller body being offset from the common axis of said registration axle and said pivot axle;

a flexible tube having a proximal end, a distal end and a wall forming a lumen therethrough, said tube being arranged in a helical turn and disposed within said chamber substantially contiguous with an interior surface of said housing, wherein a portion of said tube is contiguous with said door, and wherein rotation of said rotor assembly rotatably advances said drive roller to progressively occlude said tube in a direction from the proximal end to the distal end to pump a fluid therethrough; and occlusivity adjusting means including means for rotating said registration axle, whereby the axis of said roller member is moved in a radial direction of said rotor assembly.

16. The pump recited in claim 15, wherein said occlusivity adjusting means includes means for setting an occlusivity of said occlusivity adjusting means at a selected occlusivity.

17. The pump recited in claim 50, wherein said setting means comprises a set screw.

18. A pump comprising:

a housing forming a generally cylindrical chamber therein, said housing including a primary housing portion, a cap attachable to said primary housing portion, and a door forming an arcuate portion of a sidewall of said primary housing portion, an interior surface of said door being substantially continuous with an interior surface of said housing;

a rotor assembly including a drive roller, said rotor assembly being disposable within said housing and arranged for coaxial rotation within said chamber; and a flexible tube having a proximal end, a distal end and a wall forming a lumen therethrough, said tube being arranged in a helical turn and disposed within said chamber substantially contiguous with an interior surface of said housing, wherein a portion of said tube is contiguous with said door, and wherein rotation of said rotor assembly rotatably advances said drive roller to progressively occlude said tube in a direction from the proximal end to the distal end to pump a fluid therethrough, wherein said tube includes a tapered compression portion having a variable volume per length in a direction from the proximal end to the distal end.

19. The pump recited in claim 18, wherein said compression portion is located at the proximal end of said tube.

20. A pump comprising:

a housing forming a generally cylindrical chamber therein, said housing including a primary housing portion, a cap attachable to said primary housing portion, and a door forming an arcuate portion of a sidewall of said primary housing portion, an interior surface of said door being substantially continuous with an interior surface of said housing;

a rotor assembly including a drive roller, said rotor assembly being disposable within said housing and arranged for coaxial rotation within said chamber; and a flexible tube having a proximal end, a distal end and a wall forming a lumen therethrough, said tube being arranged in a helical turn and disposed within said chamber substantially contiguous with an interior surface of said housing, wherein a portion of said tube is contiguous with said door, wherein rotation of said rotor assembly rotatably advances said drive roller to progressively occlude said tube in a direction from the proximal end to the distal end to pump a fluid therethrough, and wherein said tube has a preformed D-shaped cross-section, and its flat side is contiguous with said housing.

21. The pump recited in claim 20, wherein a flat portion of said D-shaped cross-section is substantially contiguous with the interior surface of said housing.

* * * * *